US011072505B2

(12) United States Patent
Nishiyama

(10) Patent No.: US 11,072,505 B2
(45) Date of Patent: Jul. 27, 2021

(54) SHEET STORAGE APPARATUS AND IMAGE FORMING APPARATUS

(71) Applicant: CANON KABUSHIKI KAISHA, Tokyo (JP)

(72) Inventor: Tatsuo Nishiyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 16/391,043

(22) Filed: Apr. 22, 2019

(65) Prior Publication Data

US 2019/0332049 A1 Oct. 31, 2019

(30) Foreign Application Priority Data

Apr. 27, 2018 (JP) ..... JP2018-087529

(51) Int. Cl.
*B65H 1/26* (2006.01)
*G03G 15/00* (2006.01)

(52) U.S. Cl.
CPC ..... *B65H 1/266* (2013.01); *G03G 15/6511* (2013.01); *B65H 2405/1142* (2013.01); *B65H 2511/10* (2013.01)

(58) Field of Classification Search
CPC .... B65H 2405/1122; B65H 2405/1142; B65H 2405/11425; B65H 2405/1144; B65H 2511/10; B65H 2511/12; B65H 31/20; B65H 1/266; G03G 15/6511
USPC ..... 271/171
See application file for complete search history.

(56) References Cited

U.S. PATENT DOCUMENTS 5,013,024 A * 5/1991 Stevens ..... B65H 1/06 271/146
7,588,249 B2 * 9/2009 Caron ..... B65H 1/06 271/221
7,918,448 B2 * 4/2011 Suzuki ..... B65H 1/04 271/171
8,109,504 B2 * 2/2012 Matsuoka ..... G03G 15/6502 271/171
8,191,892 B2 * 6/2012 Fuda ..... B65H 1/04 271/241
8,622,383 B2 * 1/2014 Lee ..... B65H 1/266 271/171

(Continued)

FOREIGN PATENT DOCUMENTS

JP 2002128285 A 5/2002
JP 2011016640 A 1/2011

*Primary Examiner* — Jeremy R Severson
(74) *Attorney, Agent, or Firm* — Canon U.S.A., Inc. I.P. Division

(57) ABSTRACT

A sheet storage apparatus includes a storage unit having bottom and side surface portions and a width regulation unit that regulates a sheet edge position and includes first and second regulation members movable in a direction opposite to a movement of a moving first regulation member. The bottom surface portion is provided with first and second positioning holes to position the first regulation member, provided with first and second fixing holes. When a direction of the fixing member in a state where the first regulation member is fixed to the bottom surface portion is defined as a first direction and a direction of the fixing member in a state where the first regulation member is fixed to the side surface portion is defined as a second direction, the first direction and the second direction are other than parallel.

16 Claims, 10 Drawing Sheets

(56) References Cited

U.S. PATENT DOCUMENTS

| | | | | |
|---|---|---|---|---|
| 8,925,915 | B2 * | 1/2015 | Watanabe | B65H 1/04 271/171 |
| 9,701,494 | B1 * | 7/2017 | Mendoza | B65H 1/08 |

* cited by examiner

SHEET STORAGE APPARATUS AND IMAGE FORMING APPARATUS

BACKGROUND OF THE INVENTION

Field

The present disclosure relates to a sheet storage apparatus and an image forming apparatus.

Description of the Related Art

A sheet storage apparatus used for a main body of an image forming apparatus is configured to store various sizes of sheets and regulate positions of sheets stacked on a stacking unit included in the sheet storage apparatus.

As an example of such a sheet storage apparatus, a cassette unit configured to be detachably attachable to a main body of an image forming apparatus is known. The cassette unit includes a width regulation unit that regulates a position in a width direction of each sheet stacked on a stacking unit. This width regulation unit functions to achieve appropriate sheet conveyance by accurately regulating each sheet stacked on the stacking unit. Since various sizes of sheets are stacked on the stacking unit, it is necessary to move the width regulation unit in accordance with a sheet size.

A general width regulation unit includes a first regulation member disposed on one side in the width direction, and a second regulation member disposed on the other side in the width direction. The width regulation unit has a structure in which rack gears included in the first and second regulation members, respectively, engage with a rotation gear disposed at the center, and the rack gears move in conjunction with the movement of the rotation gear.

Some users fix the size of sheets to be used in the cassette unit. Accordingly, the width regulation unit need not be configured to be movable. In this case, there is a demand for fixing the width regulation unit to the cassette unit. For example, Japanese Patent Application Laid-Open No. 2011-16640 discusses a structure in which a width regulation unit is fixed to a cassette unit with a screw so as to prevent the width regulation unit from moving with respect to the cassette unit.

However, in the case of fixing the position of the width regulation unit, there is a possibility that the position of the width regulation unit may be erroneously fixed at a position other than a desired position, because a fixing hole for fixing corresponding to a sheet size in meters and a fixing hole for fixing corresponding to a sheet size in inches may be located extremely close to each other.

For example, the width of Letter (LTR), which is a sheet size in inches, is 216 mm, and the width of A4, which is a sheet size in meters, is 210 mm. Accordingly, the difference between the widths is 6 mm. As described above, the first regulation member and the second regulation member, which are included in the width regulation unit, are each configured to move relatively to each other with respect to the rotation gear, and the difference between the positions of the regulation members is about 3 mm. Therefore, when a user or a service person fixes the width regulation unit at a desired position, there is a possibility that the width regulation unit cannot be fixed at an appropriate one of the LTR and A4 positions.

SUMMARY OF THE INVENTION

The present disclosure is directed to providing a sheet storage apparatus that reduces a possibility of fixing a width regulation unit at an erroneous position in the case of fixing the width regulation unit. In a case where a direction of a fixing member in a state where a first regulation member is fixed to a bottom surface portion through a first positioning hole is defined as a first direction and a direction of the fixing member in a state where the first regulation member is fixed to a side surface portion through a second positioning hole is defined as a second direction, the first direction and the second direction are not parallel.

According to an aspect of the present disclosure, a sheet storage apparatus to store a sheet to be fed by a feeding member includes a storage unit configured to store a sheet and includes a bottom surface portion forming a bottom surface and a side surface portion forming a side surface, and a width regulation unit configured to regulate a position of an edge of a sheet in a width direction intersecting with a feeding direction of the feeding member, wherein the width regulation unit includes a first regulation member configured to be movable in the width direction with respect to the bottom surface portion, and a second regulation member configured to be movable with respect to the bottom surface portion, and also be movable in a direction opposite to a movement direction of the first regulation member in conjunction with a movement of the first regulation member, wherein the bottom surface portion is provided with a first positioning hole for positioning the first regulation member, and the side surface portion is provided with a second positioning hole for positioning the first regulation member, wherein the first regulation member is provided with a first fixing hole for fixing the first regulation member to the bottom surface portion by a fixing member, and a second fixing hole for fixing the first regulation member to the side surface portion by the fixing member, and wherein, in a case where a direction of the fixing member in a state where the first regulation member is fixed to the bottom surface portion through the first positioning hole is defined as a first direction and a direction of the fixing member in a state where the first regulation member is fixed to the side surface portion through the second positioning hole is defined as a second direction, the first direction and the second direction are other than parallel.

Further features of the present disclosure will become apparent from the following description of embodiments with reference to the attached drawings.

DESCRIPTION OF THE EMBODIMENTS

A first embodiment of the present disclosure will be described with reference to the accompanying drawings. The sizes, materials, shapes, relative arrangements, and the like of components described in the embodiment can be appropriately changed depending on the structures and various conditions of apparatuses to which the disclosure is applied. That is, the scope of the disclosure is not limited to the following embodiments.

Figure 1:
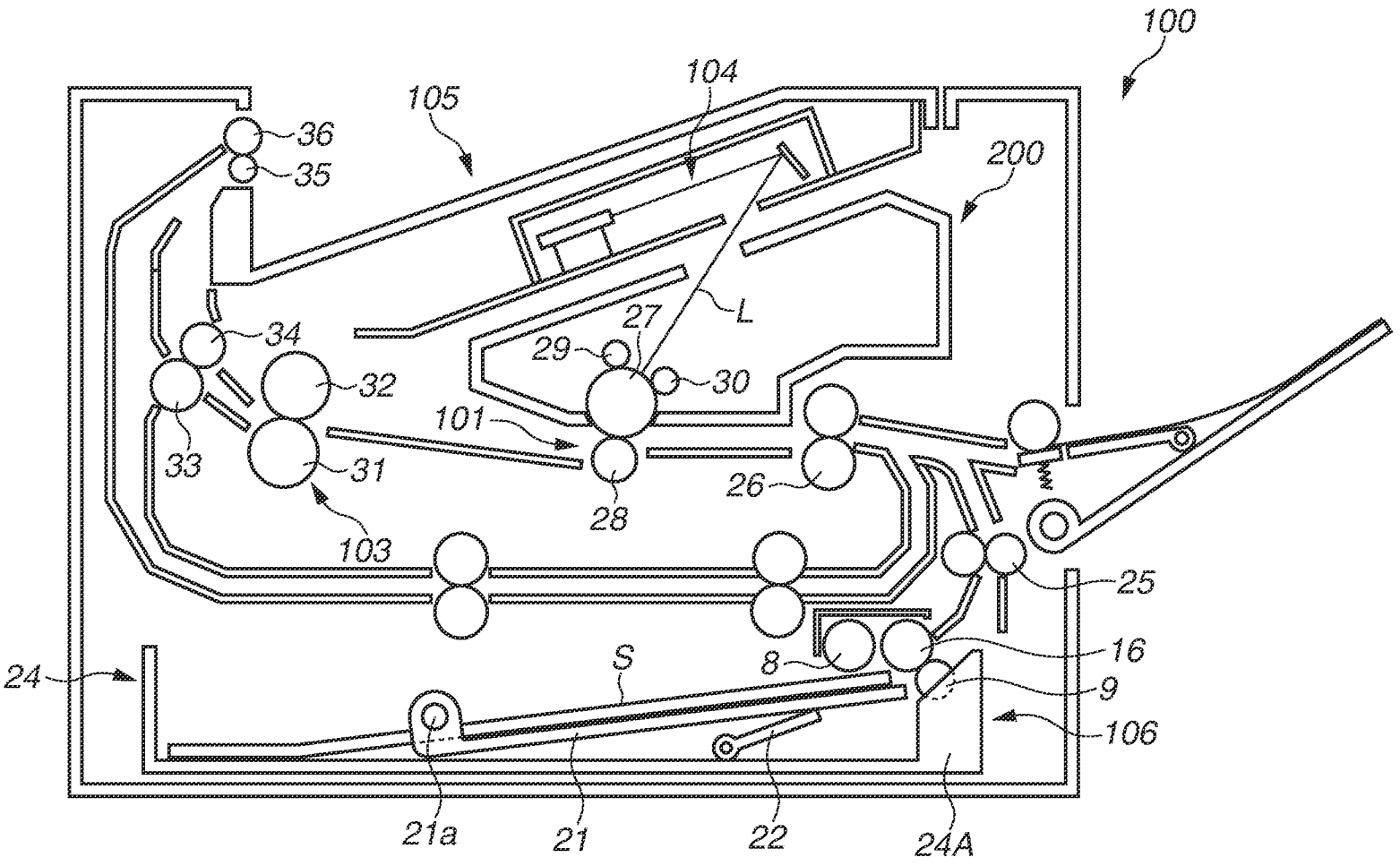
FIG. 1 is a sectional view illustrating a structure of an image forming apparatus according to a first embodiment.

FIG. 1 is a sectional view illustrating a structure of an image forming apparatus 100 that employs a color electrophotographic process. However, the present disclosure is not limited to the image forming apparatus 100 that employs an electrophotographic process. An image forming apparatus that employs a process other than the electrophotographic process, such as a printer that employs an inkjet image formation process, can also be used.

Referring to FIG. 1, the image forming apparatus 100 includes a main body, an image forming unit 200 that forms an image by the electrophotographic process, and a sheet feeding apparatus 106 that feeds a sheet S to the image forming unit 200.

The image forming unit 200 includes a photosensitive drum 27 that forms a toner image, a charging roller 29 that uniformly charges a surface of the photosensitive drum 27, and a developing device 30 that supplies toner to the photosensitive drum 27.

The sheet feeding apparatus 106 includes a cassette unit 24, which is a sheet storage apparatus that can store a plurality of sheets S, and a feeding roller 8 which is a feeding member that is provided above the cassette unit 24 and feeds each sheet S stored in the cassette unit 24.

The cassette unit 24 includes a cassette body 24A that stores the sheets S, and an intermediate plate 21 that is rotatably held by the cassette body 24A in a vertical direction using an axis 21*a* as a fulcrum and is urged against the feeding roller 8 by a lift member 22. In other words, the intermediate plate 21 is a stacking member on which a plurality of sheets S can be stacked.

The cassette body 24A constitutes a cassette case 70 (See FIG. 3) that is a support portion supporting each sheet S. The intermediate plate 21, which is the stacking member, is pressed toward the feeding roller 8 by the lift member 22, thereby pressing each sheet S stacked on the intermediate plate 21 against the feeding roller 8. The cassette unit 24 is provided with a separating member 9 that separates the sheets S, which are fed by the feeding roller 8, one by one.

An image forming operation of the image forming apparatus 100 having the structure as described above will be described. First, based on an image signal supplied from a host computer, which is not illustrated, laser light from a laser scanner 104, which is an exposure unit, is applied onto the photosensitive drum 27. The surface of the photosensitive drum 27 has been uniformly charged in advance by the charging roller 29, and is rotated clockwise. As a result, an electrostatic latent image is formed on the surface of the photosensitive drum 27. Next, the electrostatic latent image formed on the surface of the photosensitive drum 27 is developed using toner on the developing device 30, so that a toner image is formed on the surface of the photosensitive drum 27.

The feeding roller 8 and a conveyance roller 16 start rotating at a predetermined timing, and the intermediate plate 21 urged against the feeding roller 8 is rotated upward by a force of the lift member 22 in conjunction with the rotation of the feeding roller 8 and the conveyance roller 16. As a result, a leading edge of each sheet S stacked on the intermediate plate 21 is brought into press-contact with the feeding roller 8 by a predetermined force. The feeding roller 8 is controlled to be rotated counterclockwise only during sheet feeding, and feeds the sheet S, which is brought into press-contact with the feeding roller 8, by a frictional force. When a plurality of sheets S placed on the intermediate plate 21 is delivered at the same time, only the uppermost sheet S is separated by action of the separating member 9 and is then conveyed downstream.

The uppermost sheet S separated by the separating member 9 as described above is fed to a skew correction unit 25 to correct a skew of the sheet S. After that, the sheet S is conveyed to a transfer unit 101, which includes the photosensitive drum 27 and a transfer roller 28, by the skew correction unit 25 and a conveyance unit 26. In the transfer unit 101, the toner image formed on the surface of the photosensitive drum 27 as described above is electrically attracted by the transfer roller 28 and is transferred onto the sheet S.

The sheet S having the toner image transferred thereon is fed to a fixing unit 103, which includes a pressure roller 31 and a heating roller 32, and is heated and pressed by a fixing nip portion formed between the pressure roller 31 and the heating roller 32. As a result, the toner image formed on the sheet S is fixed onto the sheet S, The sheet S which has passed through the fixing unit 103 is conveyed by a pair of conveyance rollers 33 and 34 and a pair of sheet discharge rollers 35 and 36, and is discharged onto a sheet discharge tray 105.

Figure 2:
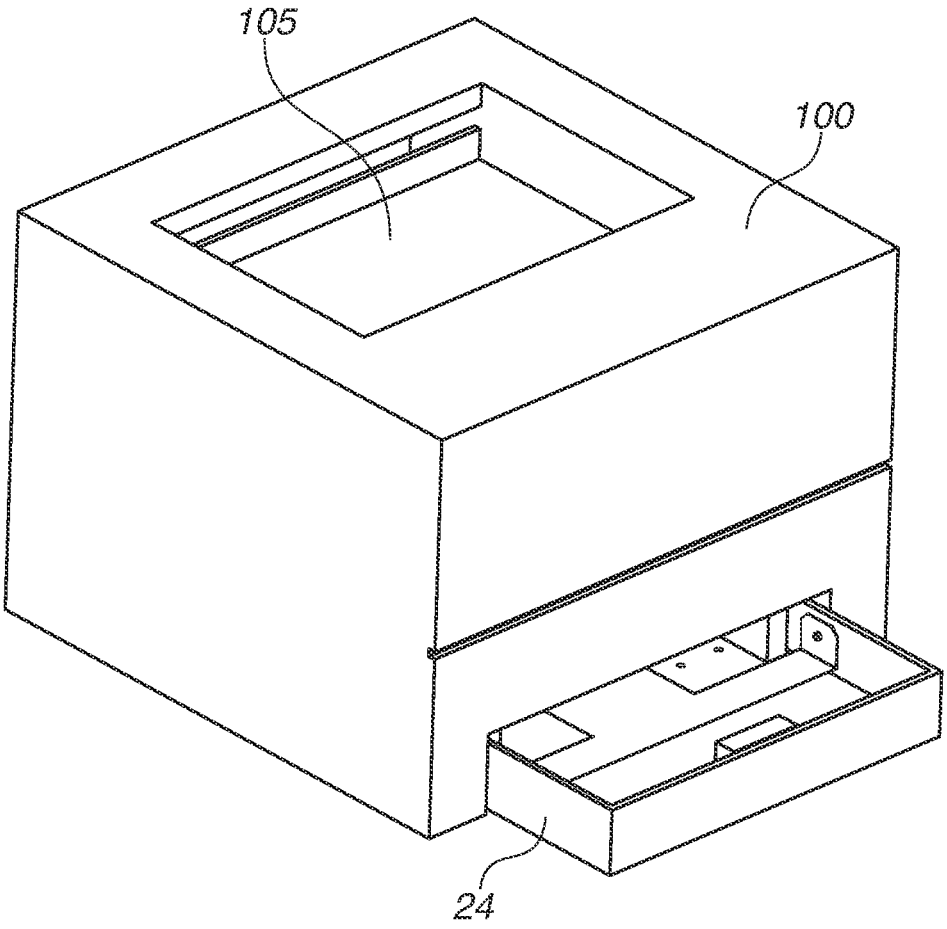
FIG. 2 is a perspective view illustrating a state where a sheet storage apparatus is being attached to or detached from the image forming apparatus.

FIG. 2 is a perspective view illustrating a state where the cassette unit 24 is being attached to or detached from the image forming apparatus 100.

Figure 3:
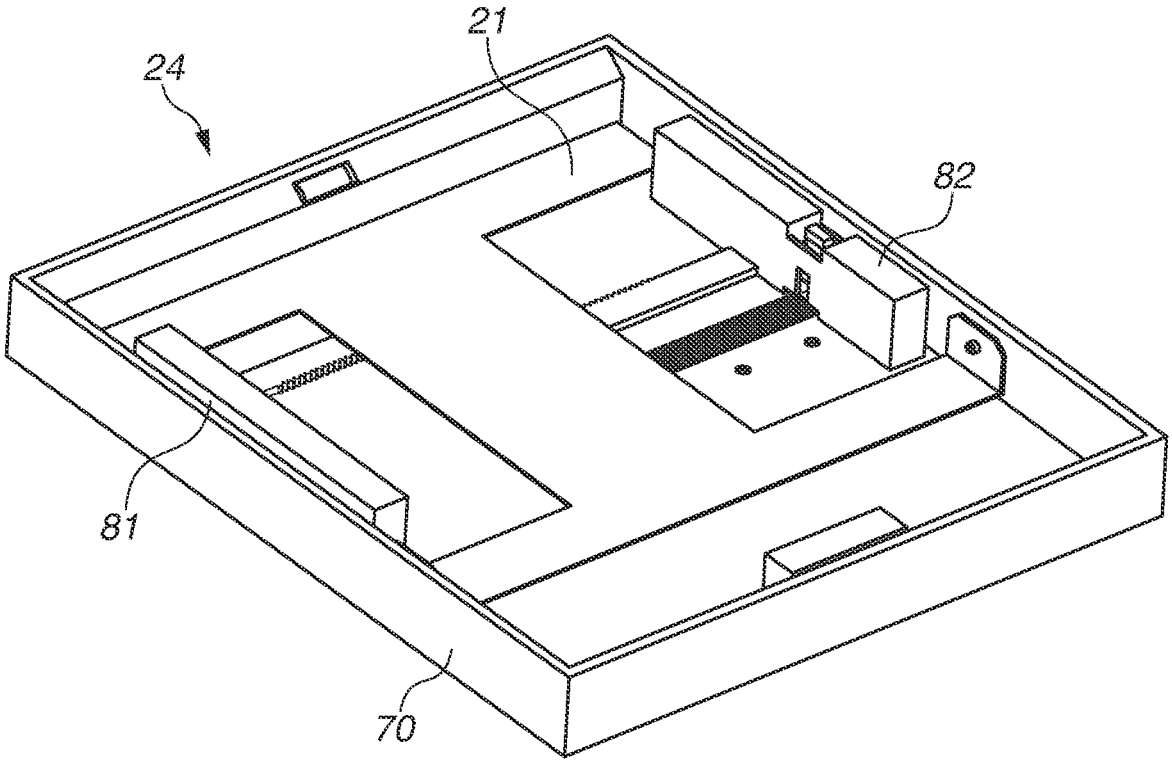
FIG. 3 is a top view illustrating a state where the sheet storage apparatus is detached from the image forming apparatus.
Figure 4:
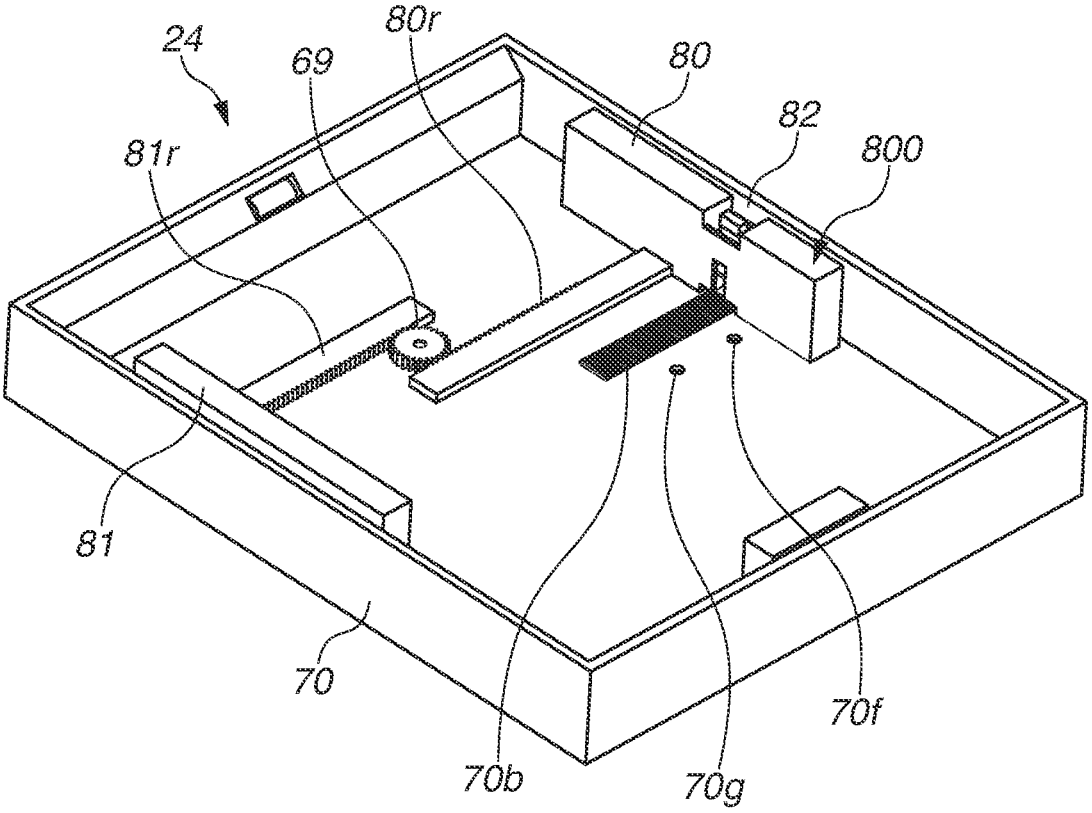
FIG. 4 is a top view of the sheet storage apparatus illustrated in FIG. 3 from which a stacking member is removed.

A structure of the cassette unit 24 will be described with reference to FIGS. 3 and 4. FIG. 3 is a top view illustrating a state where the cassette unit 24 is detached from the main body of the image forming apparatus 100. FIG. 4 is a top view of the cassette unit 24 illustrated in FIG. 3 from which the intermediate plate 21 is removed. The structure of the cassette body 24A will be described with reference to FIGS. 3 and 4.

Referring to FIGS. 3 and 4, the cassette unit 24 includes a width regulation unit 800 that regulates positions at both ends in a width direction orthogonal to a sheet conveyance direction, and the cassette case 70 which is a storage unit. The width regulation unit 800 includes a first regulation member 80 and a second regulation member 81 as a pair of regulation members. The first regulation member 80 and the second regulation member 81 are each configured to be slidably movable with respect to the cassette case 70 in a width direction which is a direction intersecting with a sheet feeding direction.

As illustrated in FIG. 4, the first and second regulation members 80 and 81 are provided with rack portions 80*r* and 81*r*, respectively. Each of the rack portions 80*r* and 81*r* includes gear teeth. A pinion gear 69, which is a rotation gear in contact with each of the rack portions 80*r* and 81*r*, is disposed to allow the first regulation member 80 and the second regulation member 81 to move by the same amount in opposite directions. In other words, the first regulation member 80 and the second regulation member 81 are configured to move in opposite directions, respectively.

The first regulation member 80 is provided with an operation lever 82. The operation lever 82 is tilted by a user, thereby enabling the first regulation member 80 and the second regulation member 81 to be slidably movable in an integrated manner. The cassette case 70 is provided with a toothed portion 70*b*, which is an engaged portion to be engaged with the second regulation member 81. Positioning holes 70*f* and 70*g* included in the cassette case 70 will be described below.

Figure 5:
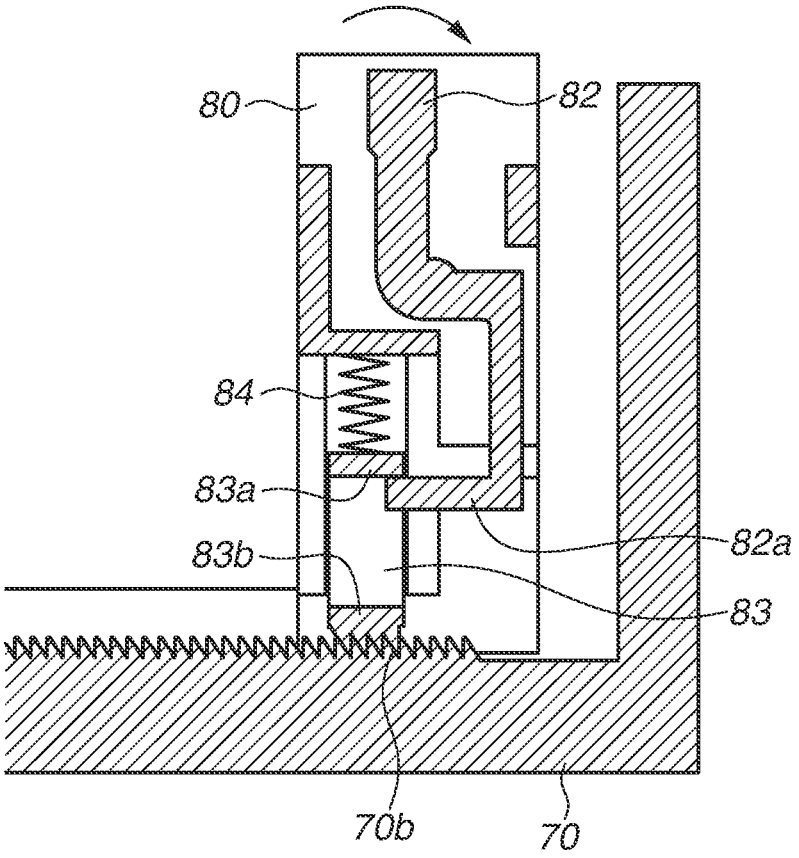
FIG. 5 is a sectional view illustrating an operation member according to the first embodiment.

FIG. 5 is a sectional view illustrating the operation lever 82 which is an operation member. A locking member 83, which is an engagement member, is provided below the operation lever 82. A toothed portion 83*b*, which is an engagement portion, is formed on a bottom surface of the locking member 83, and the cassette case 70 is also provided with the toothed portion 70*b*. The locking member 83 is urged downward by a spring 84, which is an elastic member, and the toothed portion 83*b* and the toothed portion 70*b* engage with each other, thereby regulating the movement of the first regulation member 80 with respect to the cassette case 70. When the movement of the first regulation member 80 is regulated, the movement of the second regulation member 81 through the pinion gear 69 is also regulated.

To move the first regulation member 80, the user causes the operation lever 82 to rotate in a direction indicated by an arrow in FIG. 5, so that a link portion 82*a*, which is an operating portion of the operation lever 82, comes into contact with a link portion 83*a*, which is an operated portion of the locking member 83, thereby lifting the locking member 83 upward. At this time, the toothed portion 83*b* of the locking member 83 is spaced apart from the toothed portion 70*b* of the cassette unit 24, thereby enabling the first regulation member 80 to slidably move. Then, the second regulation member 81 moves through the pinion gear 69 by the same amount n the direction opposite to that of the first regulation member 80, The user causes the first regulation member 80 and the second regulation member 81 to move toward a position depending on the size of sheets to be used, After that, the sheets are set between the first regulation member 80 and the second regulation member 81.

A method for fixing the width regulation unit 800 to the cassette case 70 will be described. In the cassette unit 24 that is assumed to be used by an unspecified number of users, a structure that allows a user to arbitrarily move the first regulation member 80 and the second regulation member 81 is not preferable in some cases. This is because, when storing sheets in the cassette unit 24, or when replacing different types of sheets, an inexperienced user may contact the operation lever 82 and may carelessly move the first regulation member 80 and the second regulation member 81.

Accordingly, in the present embodiment, the width regulation unit 800 is fixed using a dedicated fixing member and a fixing hole. The present embodiment illustrates screw fixing using a screw as the dedicated fixing member and using a screw hole as the fixing hole. However, the present disclosure is not limited to this example, Instead of using a screw, a locking pin, which is a dedicated rod member, can be used as the fixing member.

Figure 6A:
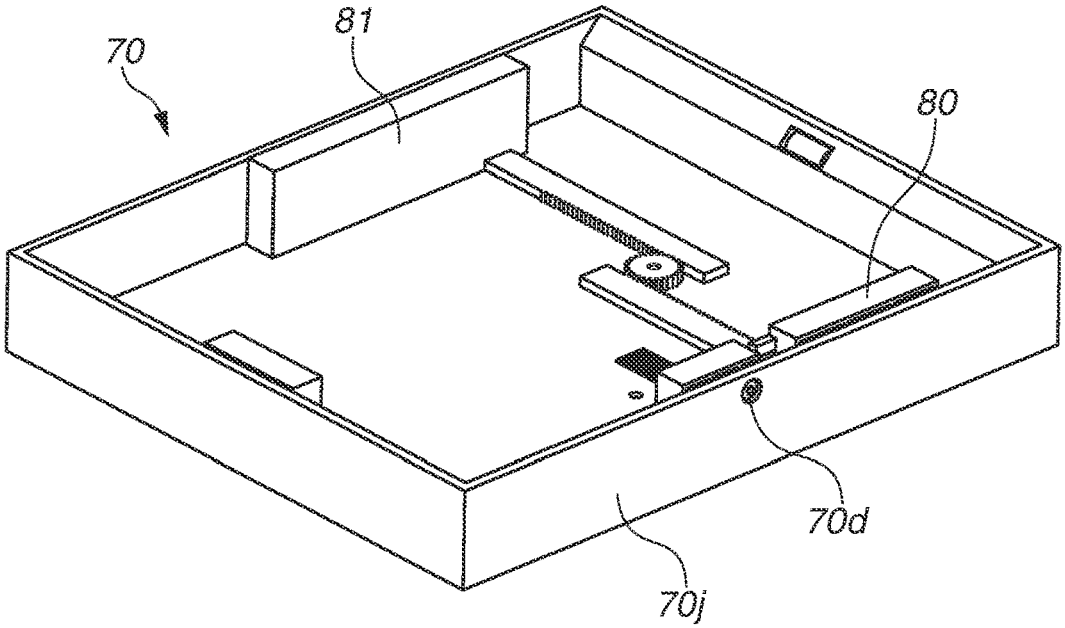
FIGS. 6A and 6B are perspective views each illustrating a plurality of positioning holes included in a storage unit according to the first embodiment.
Figure 6B:
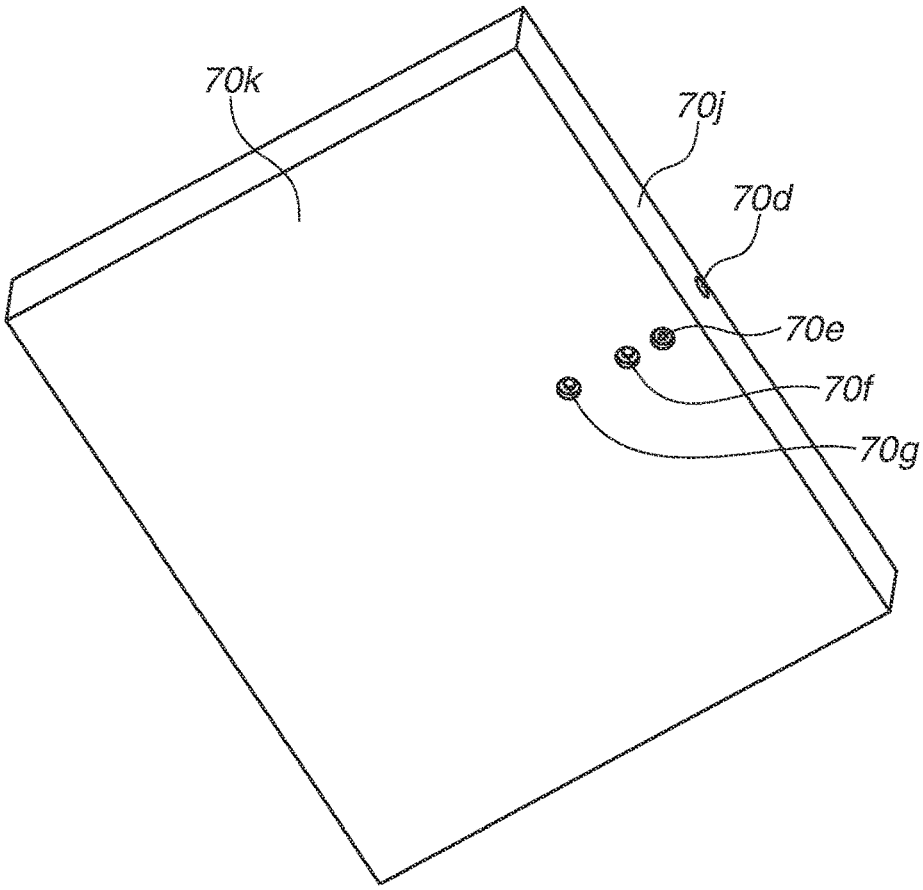

FIGS. 6A and 6B each illustrate a plurality of positioning holes 70*d*, 70*e*, 70*f*, and 70*g* included in the cassette case 70 according to the present embodiment. FIG. 6A is a perspective view illustrating the cassette case 70, and FIG. 6B is a view illustrating the cassette case 70 as viewed from its bottom surface side. The cassette case 70 includes a side surface portion 70*j* that forms a side surface of the cassette case 70, and a bottom surface portion 70*k* that forms a bottom surface of the cassette case 70. The side surface portion 70*j* and the bottom surface portion 70*k* are integrally formed in the present embodiment. When the side surface portion 70*j* and the bottom surface portion 70*k* are integrally formed, a positional accuracy of each of the positioning holes 70*d*, 70*e*, 70*f*, and 70*g* can be enhanced. However, the side surface portion 70*j* and the bottom surface portion 70*k* can be separated from each other.

Figure 7A:
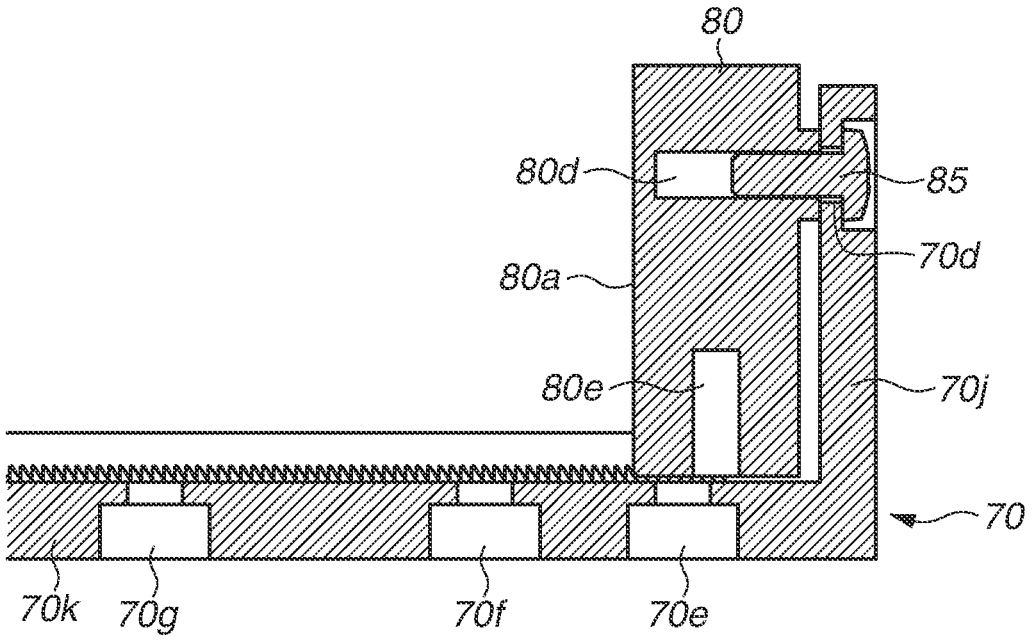
FIGS. 7A and 7B are sectional views each illustrating two types of fixing holes included in a first regulation member.
Figure 7B:
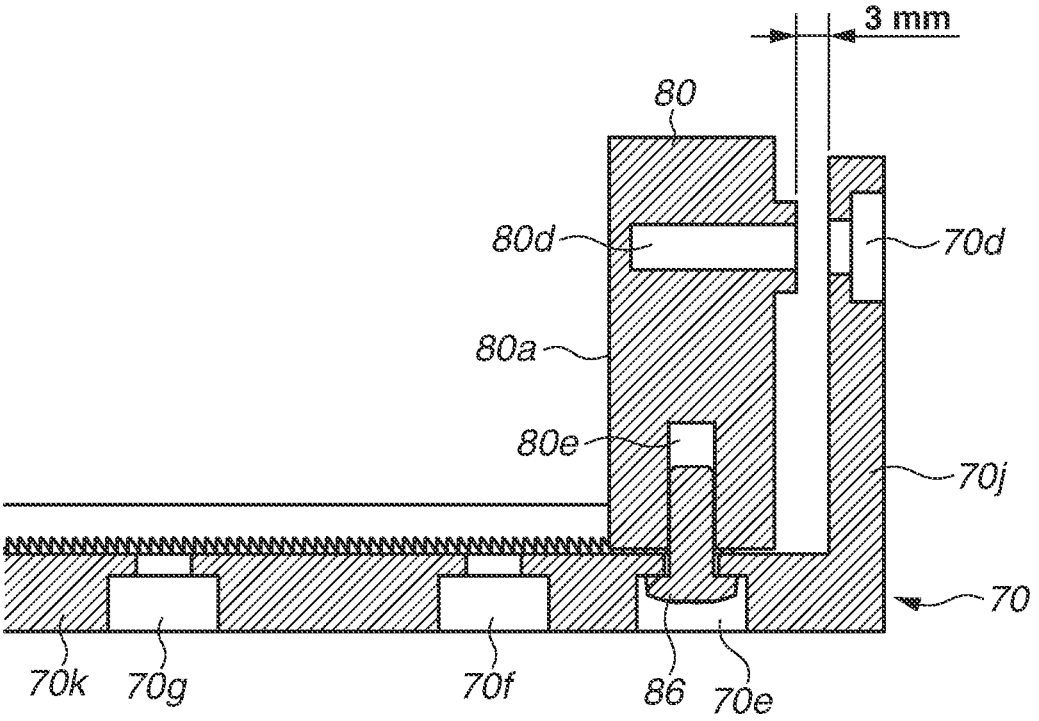

FIGS. 7A and 7B are sectional views each illustrating two types of fixing holes included in the first regulation member 80. The first regulation member 80 includes a screwing hole 80*e* as a first fixing hole, and a screwing hole 80*d* as a second fixing hole that opens in a direction different from a direction in which the screwing hole 80*e* opens. Further, the side surface portion 70*j* that forms a side surface of the cassette case 70 is provided with a second positioning hole 70*d* as a positioning hole for performing positioning. The bottom surface portion 70*k* that forms the bottom surface of the cassette case 70 is provided with the first positioning holes 70*g*, 70*f*, and 70*e* which are positioning holes for performing positioning and opens in a direction different from a direction in which the second positioning hole 70*d* opens.

The positioning holes 70*d*, 70*e*, 70*f*, and 70*g* are formed depending on the size of each sheet that can be stored in the cassette case 70. Specifically, when the regulation member 80 is fixed at a position of Letter (LTR) (a sheet size with a width of 216 mm), which is a sheet size in inches, the positions of the screwing hole 80*d* and the positioning hole 70*d* are aligned. In this state, a screw 85, which is a fixing member, is inserted into the screwing hole 80*d* through the positioning hole 70*d*. At this time, as illustrated in FIG. 7A, the screw 85 is screwed into the cassette case 70 from a side of the cassette case 70, and the first regulation member 80 is fixed to the cassette case 70.

When the regulation member 80 is fixed at a position of A4 (a sheet size with a width of 210 mm), which is a sheet size in meters, the positions of the screwing hole 80*e* and the positioning hole 70*e* are aligned. In this state, the screw 86, which is a fixing member, is inserted into the screwing hole 80*e*. At this time, as illustrated in FIG. 7B, the screw 86 is screwed into the cassette case 70 from the bottom surface side of the cassette case 70, thereby preventing the first regulation member 80 from moving. Assuming that a direction of the screw 86 used when the first regulation member 80 is fixed to the bottom surface portion 70*k* through a first positioning hole 70*e* is defined as a first direction (direction from bottom to top), and a direction of the screw 85 used when the first regulation member 80 is fixed to the side surface 70*j* through the second positioning hole 70*d* is defined as a second direction (lateral direction), the first direction and the second direction are not parallel. In the present embodiment, the first direction and the second direction are substantially orthogonal to each other.

The width of an LTR sheet is 216 mm and the width of an A4 sheet is 210 mm, and thus the difference between the widths is 6 mm. As described above, the first regulation member 80 and the second regulation member 81 are provided with the rack portions 80*r* and 81*r*, respectively, which are coupled through the pinion gear 69, The rack portions 80*r* and 81*r* and the pinion gear 69 allow the first regulation member 80 and the second regulation member 81 to move by the same amount in opposite directions. In other words, as illustrated in FIGS. 7A and 7B, the difference between an LTR position of the first regulation member 80 and an A4 position of the first regulation member 80 is only 3 mm.

Accordingly, if the first positioning hole 70*e* and the second positioning hole 70*d* are provided only on the bottom surface portion 70*k*, there is a possibility that the first regulation member 80 may be fixed at the LTR position, although the user intends to fix the first regulation member 80 at the A4 position. However, according to the present embodiment, in a case of fixing the first regulation member 80 at the LTR position, the first regulation member 80 is fixed to the side surface portion 70*j* of the cassette case, and in a case of fixing the first regulation member 80 at the A4 position, the first regulation member 80 is fixed to the bottom surface portion 70*k*, so that the possibility of fixing the first regulation member 80 to an erroneous position can be reduced.

Although the present embodiment illustrates an example in which the positioning hole 70*d* is set at the LTR position, the present disclosure is not limited to this example. The positioning hole 70*d* provided in the side surface portion 70*j* can be set at a position other than the LTR position depending on the size of each sheet that can be stored in the cassette unit 24. The positioning hole 70*d* can be provided as a position corresponding to a position that corresponds to a sheet size with a maximum width (maximum size) in a width direction among the sheets that can be stored in the cassette unit 24.

The cassette case 70 is also provided with the positioning holes 70*f* and 70*g* corresponding to standard-size sheets of a sheet size smaller than A4. Accordingly, the width regulation unit 800 can also be fixed at a position corresponding to a sheet size smaller than A4.

The first embodiment described above illustrates the structure in which the first regulation member 80 is fixed to the side surface portion 70*j* of the cassette case 70. A second embodiment differs from the first embodiment in that the first regulation member 80 is fixed by changing a direction in which the fixing member is inserted into the bottom surface portion 70*k*. Components of the second embodiment that are similar to those of the first embodiment are denoted by the same reference numerals as those of the first embodiment.

Figure 8A:
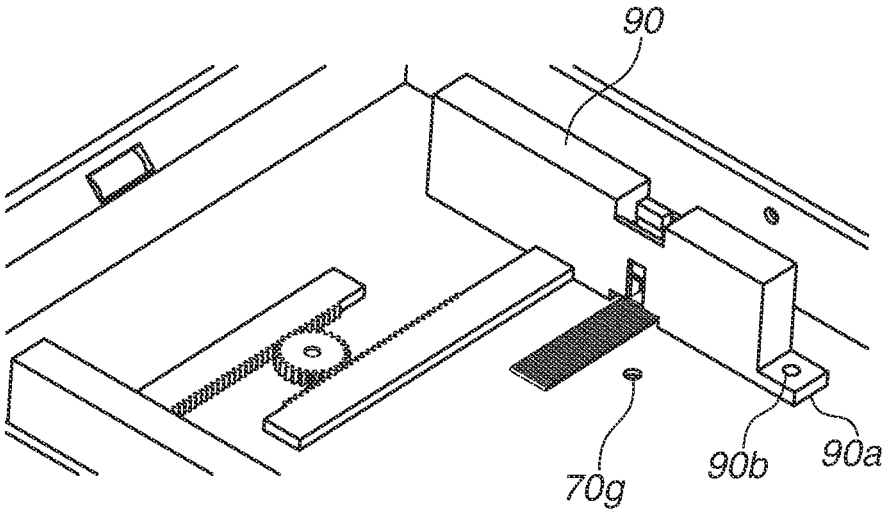
FIG. 8A is a perspective view illustrating a fixing position of the first regulation member according to a second embodiment.
Figure 8B:
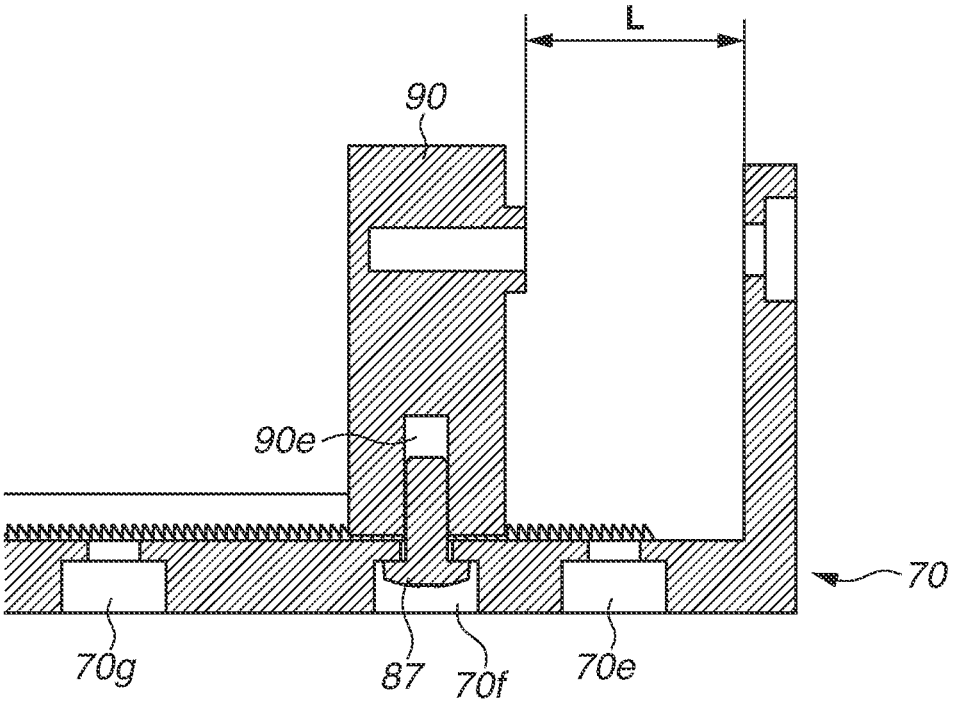
FIG. 8B is a sectional view of a positioning hole.
Figure 9A:
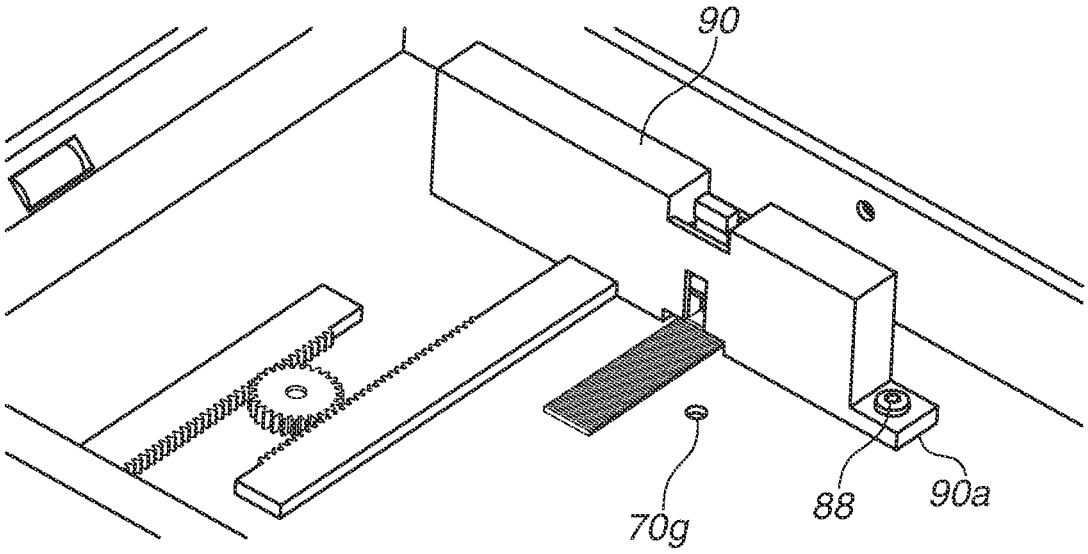
FIG. 9A is a perspective view illustrating a fixing position of the first regulation member according to the second embodiment.
Figure 9B:
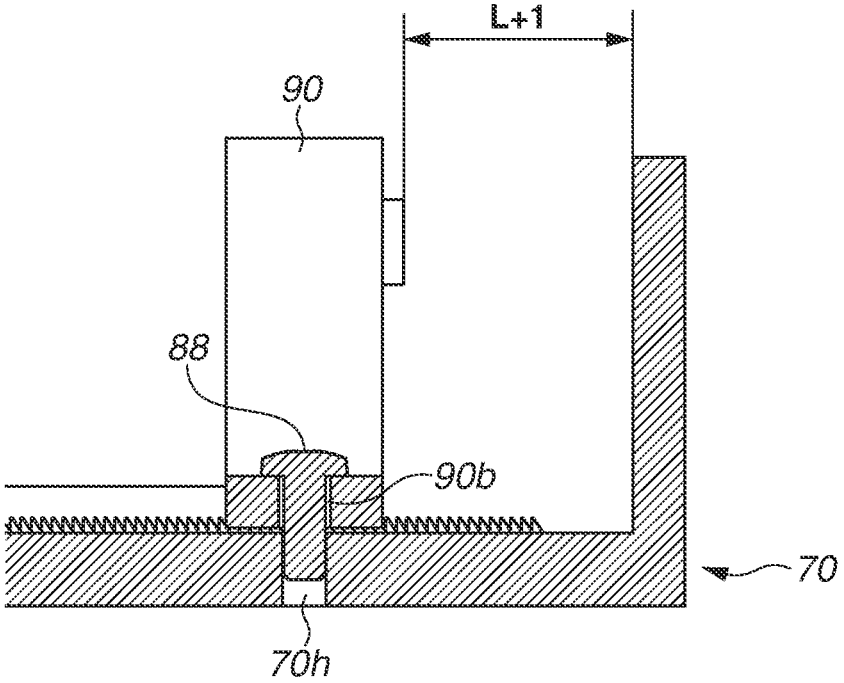
FIG. 9B is a sectional view illustrating a screw.

FIGS. 8A and 8B each illustrate that a first regulation member 90, which is a first regulation member, is aligned with an Executive (EXE) position. FIG. 8A is a perspective view, and FIG. 8B is a sectional view illustrating the positioning hole 70*g*. The term "EXE" used herein refers to a standard-size sheet with a sheet width of 186 mm. FIGS. 9A and 99 each illustrate that the position of the first regulation member 90 is adjusted so as to store a B5-size sheet. FIG. 9A is a perspective view, and FIG. 9B is a sectional view illustrating a screw 88. The term "B5" used herein refers to a standard-size sheet with a sheet width of 184 mm hi this case, the sheet width of EXE is 186 mm and the sheet width of B5 is 184 mm, and thus the difference between the widths is 2 mm. Accordingly, the difference between the position of the first regulation member 90 illustrated in FIGS. 8A and 8B and the position of the first regulation member 90 illustrated in FIGS. 9A and 9B is only 1 mm.

Specifically, when a distance between the first regulation member 90 and the cassette case 70 is defined by L as illustrated in FIG. 8B, a distance between the first regulation member 90 and the cassette case 70 illustrated in FIG. 9B is represented by L+1, As illustrated in FIG. 8B, when the first regulation member 90 is fixed at the EXE position, a screw 87 passes through the positioning hole 70*f* of the cassette case 70, and is screwed into a fixing hole 90*e* of the first regulation member 90, As illustrated in FIG. 99, when the first regulation member 90 is fixed to the B5 position, the screw 88 passes through a through-hole 90*b* of the first regulation member 90, and is screwed into a fixing hole 70*h* of the cassette case 70.

As described above, even when the difference between sheet sizes is small, the possibility of fixing the first regulation member 90 with a screw at an erroneous position can be drastically reduced merely by changing the direction in which the screw is screwed by 180 degrees depending on the sheet size based on which the first regulation member 90 is fixed.

Figure 10A:
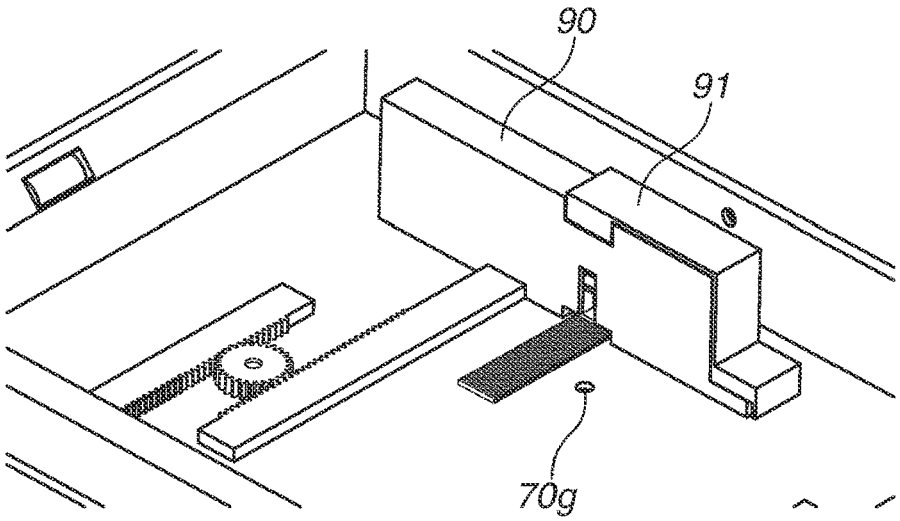
FIGS. 10A, 10B, and 10C each illustrate a protective member according to a modified example of the second embodiment.
Figure 10B:
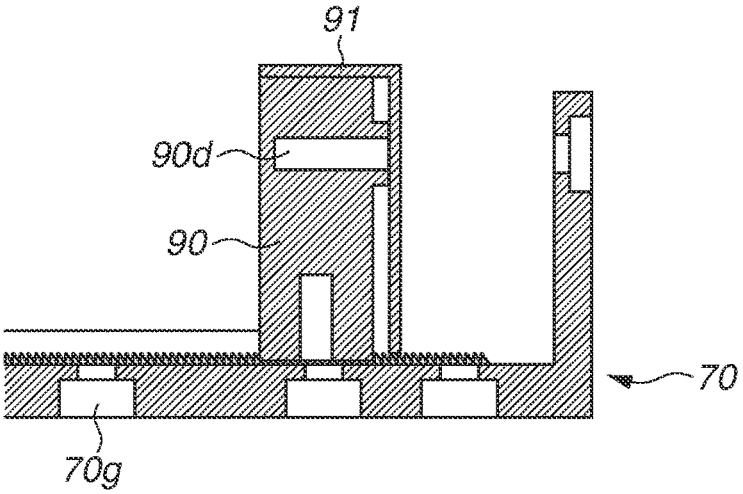
Figure 10C:
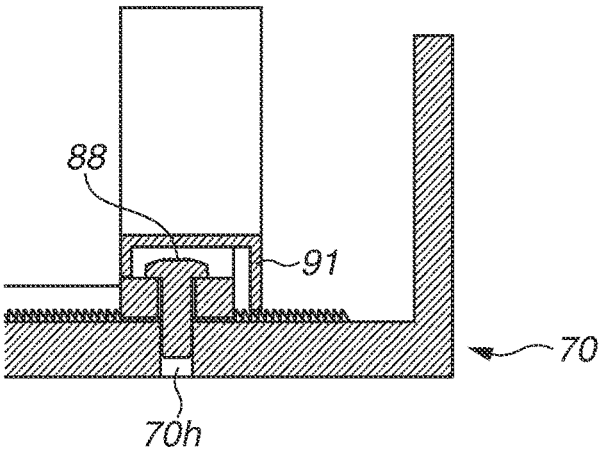

FIGS. 10A to 10C each illustrate a modified example of the second embodiment. FIGS. 10A to 10C each illustrate that a cover member 91, which is a protective member, is attached to the first regulation member 90. As illustrated in FIG. 10A, the cover member 91 covers the operation lever 82, which prevents the user from touching the operation lever 82. Accordingly, the cassette unit 24 is less likely to be damaged. Further, as illustrated in FIG. 10B, the cover member 91 covers a fixing hole 90*d* of the first regulation member 90, which prevents the user from erroneously screwing a screw into the fixing hole 90*d*.

Further, as illustrated in FIG. 10C, the cover member 91 covers the screw 88 fixed into the fixing hole 70*h* of the cassette case 70, which prevents the user from erroneously removing the screw 88.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No, 2018-087529, filed Apr. 27, 2018, which is hereby incorporated by reference herein in its entirety.

What is claimed is:

1. A sheet storage apparatus to store a sheet to be fed by a feeding member, the sheet storage apparatus comprising:

a storage unit configured to store the sheet and includes a bottom surface portion forming a bottom surface and a side surface portion forming a side surface; and a width regulation unit configured to regulate a position of an edge of the sheet in a width direction intersecting with a feeding direction of the feeding member, wherein the width regulation unit includes a first regulation member configured to be movable in the width direction with respect to the bottom surface portion, and a second regulation member configured to be movable with respect to the bottom surface portion, wherein the second regulation member also is configured to be movable in a direction opposite to a movement direction of the first regulation member in conjunction with a movement of the first regulation member, wherein the bottom surface portion is provided with a first positioning hole for positioning the first regulation member, and the side surface portion is provided with a second positioning hole for positioning the first regulation member, wherein the first regulation member is provided with a first fixing hole for fixing the first regulation member to the bottom surface portion by a fixing member, and a second fixing hole for fixing the first regulation member to the side surface portion by the fixing member, and wherein, in a case where (i) a direction of the fixing member, in a state where the first regulation member is fixed to the bottom surface portion through the first positioning hole, is defined as a first direction, and (ii) a direction of the fixing member, in a state where the first regulation member is fixed to the side surface portion through the second positioning hole, is defined as a second direction, the first direction and the second direction are other than parallel.

2. The sheet storage apparatus according to claim 1, wherein, in the state where the first regulation member is fixed to the side surface portion through the second positioning hole, a position of the first regulation member is a position corresponding to an edge portion of a letter-size sheet.

3. The sheet storage apparatus according to claim 2, wherein, in the state where the first regulation member is fixed to the bottom surface portion through the first positioning hole, a position of the first regulation member is a position corresponding to an edge portion of an A4-size sheet.

4. The sheet storage apparatus according to claim 1, wherein the fixing member is a screw.

5. The sheet storage apparatus according to claim 4, wherein the screw is inserted into the second fixing hole in the state where the first regulation member is fixed to the side surface portion through the second positioning hole.

6. The sheet storage apparatus according to claim 4, wherein the screw is inserted into the first fixing hole in the state where the first regulation member is fixed to the bottom surface portion through the first positioning hole.

7. The sheet storage apparatus according to claim 1, further comprising a rotation gear in contact with each of the first regulation member and the second regulation member, wherein the second regulation member also is configured to be movable in conjunction with a movement of the first regulation member by the rotation gear.

8. The sheet storage apparatus according to claim 1, wherein, in the state where the first regulation member is fixed to the side surface portion through the second positioning hole, a size of the sheet regulated by the first regulation member is the size of a first sheet, wherein, in the state where the first regulation member is fixed to the bottom surface portion through the first positioning hole, the size of the sheet regulated by the first regulation member is the size of a second sheet, and wherein the size of the first sheet is larger than the size of the second sheet.

9. An image forming apparatus comprising:

an image forming unit configured to form a toner image on a sheet;

a feeding member configured to feed a sheet to the image forming unit; and a sheet storage apparatus to store a sheet to be fed by a feeding member, wherein the sheet storage apparatus includes:

a storage unit configured to store the sheet and includes a bottom surface portion forming a bottom surface and a side surface portion forming a side surface, and a width regulation unit configured to regulate a position of an edge of the sheet in a width direction intersecting with a feeding direction of the feeding member, wherein the width regulation unit includes a first regulation member configured to be movable in the width direction with respect to the bottom surface portion, and a second regulation member configured to be movable with respect to the bottom surface portion, wherein the second regulation member also is configured to be movable in a direction opposite to a movement direction of the first regulation member in conjunction with a movement of the first regulation member, wherein the bottom surface portion is provided with a first positioning hole for positioning the first regulation member, and the side surface portion is provided with a second positioning hole for positioning the first regulation member, wherein the first regulation member is provided with a first fixing hole for fixing the first regulation member to the bottom surface portion by a fixing member, and a second fixing hole for fixing the first regulation member to the side surface portion by the fixing member, and wherein, in a case where (i) a direction of the fixing member, in a state where the first regulation member is fixed to the bottom surface portion through the first positioning hole, is defined as a first direction, and (ii) a direction of the fixing member, in a state where the first regulation member is fixed to the side surface portion through the second positioning hole, is defined as a second direction, the first direction and the second direction are other than parallel.

10. The image forming apparatus according to claim 9, wherein, in the state where the first regulation member is fixed to the side surface portion through the second positioning hole, a position of the first regulation member is a position corresponding to an edge portion of a letter-size sheet.

11. The image forming apparatus according to claim 10, wherein, in the state where the first regulation member is fixed to the bottom surface portion through the first positioning hole, a position of the first regulation member is a position corresponding to an edge portion of an A4-size sheet.

12. The image forming apparatus according to claim 9, wherein the fixing member is a screw.

13. The image forming apparatus according to claim 12, wherein the screw is inserted into the second fixing hole in the state where the first regulation member is fixed to the side surface portion through the second positioning hole.

14. The image forming apparatus according to claim 12, wherein the screw is inserted into the first fixing hole in the state where the first regulation member is fixed to the bottom surface portion through the first positioning hole.

15. The image forming apparatus according to claim 9, further comprising a rotation gear in contact with each of the first regulation member and the second regulation member, wherein the second regulation member also is configured to be movable in conjunction with a movement of the first regulation member by the rotation gear.

16. The image forming apparatus according to claim 9, wherein, in the state where the first regulation member is fixed to the side surface portion through the second positioning hole, a size of the sheet regulated by the first regulation member is the size of a first sheet, wherein, in the state where the first regulation member is fixed to the bottom surface portion through the first positioning hole, the size of the sheet regulated by the first regulation member is the size of a second sheet, and wherein the size of the first sheet is larger than the size of the second sheet.

* * * * *